United States Patent [19]

Jensen

[11] Patent Number: 4,549,487

[45] Date of Patent: Oct. 29, 1985

[54] PRACTICE PROJECTILE WITH VARIABLE RANGE

[75] Inventor: Jens C. Jensen, Kokkedal, Denmark

[73] Assignee: Pocal Industries, Inc., Moscow, Pa.

[21] Appl. No.: 537,121

[22] Filed: Sep. 29, 1983

[51] Int. Cl.[4] ..... F42B 13/20

[52] U.S. Cl. ..... 102/498; 102/445; 102/529

[58] Field of Search ..... 102/444, 488, 498, 495, 102/529, 395, 334, 372–374, 503, 445; 244/3.23

[56] References Cited

U.S. PATENT DOCUMENTS

| | | | |
|---|---|---|---|
| 922,638 | 5/1909 | Spencer | 244/3.23 |
| 2,497,888 | 2/1950 | Hirschfelder | 244/3.23 |
| 2,801,586 | 8/1957 | Mongello | 162/529 |
| 2,892,400 | 6/1959 | Zaharakis | 102/529 |
| 3,374,738 | 3/1968 | Gawlick et al. | 102/529 |
| 3,789,763 | 2/1974 | Donner | 102/373 |
| 4,109,579 | 8/1978 | Carter | 102/445 |
| 4,175,492 | 11/1979 | Knappworst et al. | 102/503 |
| 4,296,893 | 10/1981 | Ballmann | 244/3.23 |

*Primary Examiner*—Harold J. Tudor
*Attorney, Agent, or Firm*—Neil F. Markva

[57] ABSTRACT

The practice projectile of this invention has a variable projectile range when fired from the barrel of a firearm. The projectile comprises a shell body portion having a front end section and a rear end section and includes an outer surface, an inner gas-conveying passage, propellant gas ingress openings and propellant gas exit openings. The outer surface includes an outer, caliber section which contacts the inside surface of the barrel out of which the projectile is fired. The outer caliber section is located intermediate the front and rear end sections. The inner gas-conveying passage extends between the front end and rear end sections. The propellant gas ingress openings are located in the rear end section and openly connect the rear end section of the inner gas-conveying passage to the outside of the shell body. The propellant gas exit openings are located in the front end section and openly connect the front end section of the inner gas-conveying passage to the outside of the shell body. Upon firing of the firearm, the shell body is effective to direct resultant propellant gases to move through the propellant gas ingress openings, forwardly along the inner gas conveying passage and out the propellant gas exit opening.

14 Claims, 3 Drawing Figures

PRACTICE PROJECTILE WITH VARIABLE RANGE

FIELD OF THE INVENTION

The invention described herein relates to large caliber training ammunition and simulator systems used to train military personnel. More particularly, the invention is directed to the simulation of actual projectiles which are substantially identical to regulation equipment so that the actual firing conditions are substantially duplicated.

BACKGROUND OF THE INVENTION

Attempts to simulate actual firing conditions in the training of military personnel is well known. There have been various approaches taken in the prior art to achieve variable muzzle velocity for practice mortar shell. The U.S. Pat. No. 3,946,637 and patents cited therein are directed to various types of mortar configurations for adjusting the velocity of a single charge cartridge. This involves a modification of the standard mortar tube of the firearm from which the projectile is fired.

The U.S. Pat. No. 2,801,586 discloses a subcaliber mortar training shell which was developed to simulate the firing of a regulation sized mortar in training the combat men. This prior art device involves a fairly complex structural configuration for the mortar shell with charges being implanted in the shell body portion of the projectile. There is a manipulation requiring alignment of apertures and a modification which must be done to the fire arm barrel in order to use the subcaliber mortar trainer shell of the prior art. Since the firearm and the shell of this earlier U.S. Pat. No. 2,801,586 require significant modification with respect to the actual regulation sized firearm and projectile, the simulation of actual firing conditions is not possible.

PURPOSE OF THE INVENTION

The primary object of this invention is to provide a shell or projectile which simulates the actual size of a projectile that is fired from an actual firearm used to fire regulation sized mortars.

Another object of the invention is to provide a practice projectile which is constructed so as to provide a regulation sized shell which may be fired over a variable projectile range.

A still further object of this invention is to provide a practice projectile having a regulation caliber size and to be quickly loaded into a regulation firearm for training military personnel under simulation of actual firing conditions.

SUMMARY OF THE INVENTION

The practice projectile or shell as disclosed herein comprises a shell body portion having a front end section and a rear end section and includes an outer surface, an inner gas-conveying passage, propellant gas ingress aperture means and propellent gas exit aperture means. The outer surface includes an outer, caliber section which contacts the inside surface of the barrel out of which the shell is fired. The outer, caliber section is located intermediate the front and rear end sections of the shell body. The inner gas-conveying passage extends between the front end and rear end sections. The propellent gas ingress aperture means are located in the rear end section and openly connect the rear end section of the inner gas-conveying passage to the outside of the shell body. The propellant gas exit aperture means are located in the front end section of the shell body and openly connect the front end section of the inner gas-conveying passage to the outside of the shell body. Upon firing of the firearm, the shell body is effective to direct resultant propellant gases to move through the propellent gas ingress aperture means, forwardly along the inner gas-conveying passage and out the propellent gas exit aperture means.

The shell body may be disposed between a fuse portion located at the front end section and a tail portion located at the rear end section. In a particular feature of the invention, the ingress aperture means includes a plurality of openings disposed at preselected locations around the circumference of the shell body portion. The propellant gas ingress aperture means may also include plug means for closing the openings. The arrangement has the advantage that by changing the number or size of holes, the range of the projectile can vary and thereby achieve the precise range conditions desired. The plug means include plug members individually shaped to separately and independently close each of the plurality of openings whereby the range of a projectile incorporating the shell portion is shortened for each plug member which is removed from an opening to uncover the opening. Thus, propellent gas pressure is released through the gas-conveying passage and out of the propellant gas exit opening at the front end section of the shell body.

The use of donut-shaped charge members to propel fin-stabilized projectiles is very well known. These donut-shaped charge members are also known as propellant increment charges which are disposed along an auxiliary charge holding section of the tail portion of a fin-stabilized projectile. One embodiment of the present invention has the plug members used to close the openings at the rear end section of the shell body to be shaped like the donut-shaped propellant increment charges. Thus, the range of the training projectile may vary in the same ratio as an actual projectile when each donut-shaped increment charge is removed from the tail end section. That is, use of the appropriate size and number of openings will release the propellant gas pressure through the inner gas-conveying passage of the shell body.

The exit aperture means includes an opening area that is greater than the total area of all of the ingress openings which are uncovered by an amount sufficient to prevent pressure build-up within the gas-conveying passage. The area of each of the ingress openings is effective to release propellant gas pressure through the gas-conveying passage in a preselected manner.

In one embodiment of the invention, a single ignition charge is located in the tail portion. There is a plurality of openings located in the rear end section of the shell body with the exit openings being located in the front end section of the body. The relationship between the ingress openings and the exit openings is such that when plug members are used to close all of the openings, the projectile will travel its maximum range using only the propellant gases generated out of the single ignition charge. Without changing the charge size or having to consider use of additional propellant increment charges, it is simply a matter of removing a plug member from each of the openings located in the rear end section. As each plug member is removed from the opening, a greater amount of the propellant gas pressure is released and the total range of the projectile is reduced accordingly.

In another embodiment of the present invention, all of the openings located in the rear end section of the shell body portion are always open. In this instance however, there is room to place four propellant incremental charges onto the auxiliary charge holding section of the tail portion of the fin-stabilized projectile. These same incremental charges are used to fire under actual firing conditions. With all of the openings remaining uncovered, the actual variable ranges can be simulated by using only the initial ignition charge or up to four additional propellant increment charges. The training projectile of this invention shall have a range of from about 1/10 to 1/5 times the range of the active ammunition. That means that training can take place in fields with dimensions of hundreds of meters rather than in kilometers or miles.

Another feature is directed to the use of a fuse portion which includes a spotting charge or detonating signal charge section extending into the gas-conveying passage of the shell body portion. The exit and ingress aperture means each has a opening area and the ratio between the exit and ingress opening areas is effective to preclude pressure build-up within the shell body thereby preventing damage to the detonating signal charge section.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
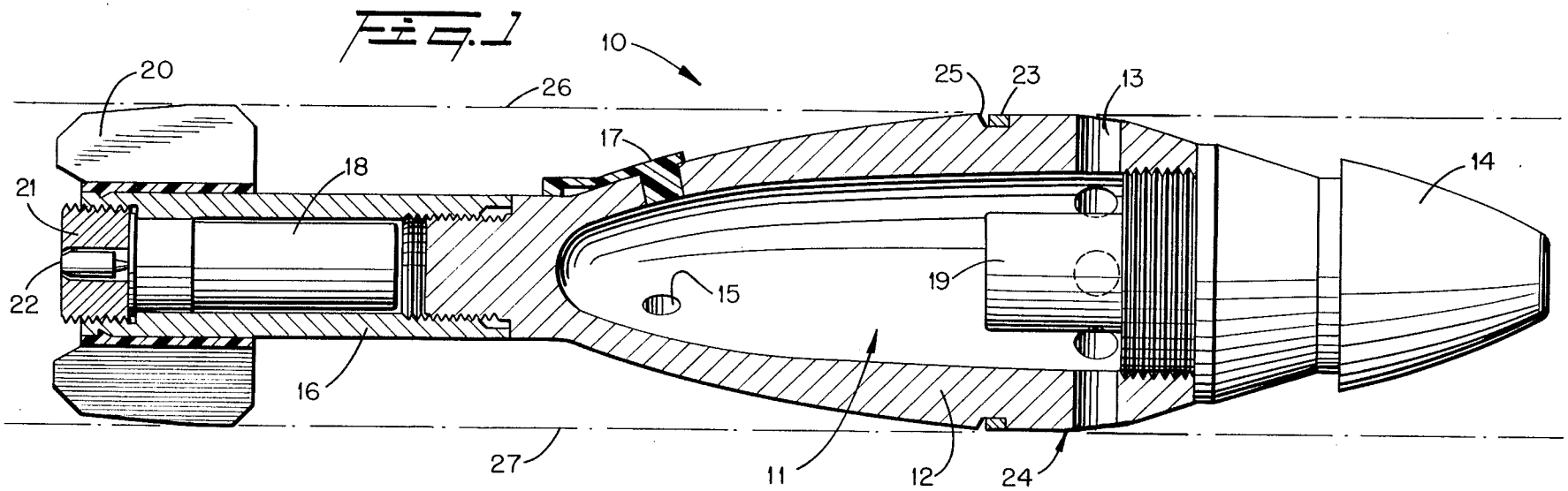
FIG. 1 is a fragmentary cross-sectional view of a projectile made in accordance with this invention.

The fin-stabilized projectile, generally designated 10, includes a shell body portion 12, a nose fuse portion 14 and a tail portion 16. Fuse portion 14 threadingly engages the front end section of shell body portion 12 and includes a spotting charge or detonating signal charge section 19. The tail portion 16 threadingly engages the rear end section of shell body portion 12 and includes fins 20 to stabilize the projectile 10 in the well known manner. The sizes and shapes of the various parts of projectile 10 are standard and are equivalent to the sizes and shapes of a regular caliber mortar shell. This projectile may be designed as a 60 mm, 81 mm, 120 mm or any other caliber training device for military personnel who can simulate actual firing conditions through the use of the projectile made in accordance with this invention.

The dash/dot lines 26 and 27 represent the profile of the inside surface of a firearm barrel from which the practice shell 10 is to be fired. Shell body portion 12 includes an outer surface having an outer, caliber section 24 which contacts the inside surface of the barrel out of which the projectile 10 is fired. The outer caliber section 24 is located intermediate the front and rear end sections of shell body portion 12. Obturating ring 23 is disposed in a circumferential groove 25 formed in the outer surface of shell body portion 12 to operate in a manner well known in the prior art. That is, obturating ring 23 expands outwardly when the propellant gases from the charge 18 are discharged upon detonation. As shown, charge 18 is a 20-gauge shotgun shell that is detonated through the firing pin 22 movably disposed within breech plug member 21. When shell 10 is dropped into the barrel of the firearm, the firing pin 22 engages a projection in the firearm in a well known manner, and in turn, detonates the firing charge 18. The resultant propellant gases thrust the projectile 10 out of the barrel of the firearm in the well known manner.

Shell body portion 12 includes an inner gas-conveying passage 11 which extends between the front end and rear end sections thereof. Propellant gas ingress aperture means include openings 15 which extend through the wall of the shell body portion 12. Three 9/32 inch openings 15 are circumferentially spaced 120° apart around the rear end section and openly connect the rear end section of the inner gas-conveying passage 11 to the outside of shell body portion 12. Propellant gas exit aperture means include drilled openings 13 having a diameter of about 5/16 inch and circumferentially spaced 45° around the entire front end section of shell body portion 12. Openings 13 openly connect the front end section of the inner gas-conveying passage 11 to the outside of shell body portion 12. Upon firing of the firearm, the shell body portion 12 is effective to direct the beforehand chosen propellant gases through the propellant gas ingress openings 15, forwardly along the inner gas-conveying passage 11 and out the propellant gas exit openings 13.

The ingress aperture means includes plug 17 which is used to close an opening 15 as shown. In this embodiment, the ingress aperture means includes three openings 15 and plug means for closing each of the openings separately and independently with respect to each other. The total area of the plurality of openings 13 is several times greater than the total area of all of the ingress openings 15 by an amount sufficient to prevent pressure build-up within the gas-conveying passage 11. The area of each of the ingress openings 15 is effective to release propellant gas pressure through the gas-conveying passage 11 and out the exit openings 13 to achieve preselected projectile ranges for the projectile 10. The size or number of holes 15 can vary the range of the projectile and thereby obtain conditions which are wanted with respect to the use of the practice ammunition. In this particular embodiment, when all three holes or openings 15 are open, the projectile is designed to be fired a range of about 250 meters. When one hole 15 is plugged by a plug member 17, the range is about 400 meters. When two holes are plugged, projectile range is about 500 meters and when all of the holes or openings 15 are plugged with plug members 17, the range of projectile 10 is about 600 meters. In this particular embodiment, the single ignition charge 18 located in tail portion 16 is effective to achieve the entire combination of ranges depending upon the number of openings 15 that are opened and closed.

Thus, the ingress aperture means of projectile 10 includes a plurality of openings 15 disposed at preselected locations around the circumference of shell body portion 12. The plug members 17 are individually shaped to separately and independently close each of the plurality of openings 15. The range of a projectile incorporating the shell portion 12 is shortened for each plug member 17 which is removed from an opening 15. The uncovered opening 15 allows the propellant gas pressure to be released through the gas-conveying passage 11 and out of the propellant gas exit openings 13. The opening area of the exit openings 13 is in a predetermined ratio with respect to the opening area of the ingress openings 15.

In this embodiment, the opening area of the exit openings 13 is from about 3 to about 5 times the opening area of the ingress openings 15. Additionally, the spotting charge or detonating signal charge section 19 extends into the gas-conveying passage 11 of shell body portion 12. The ratio between the areas for the exit openings 13 and ingress opening 15 is effective to preclude pressure build-up within the shell body portion 12 whereby the number and exact size of openings 15 determine the pressure in the weapon behind the projectile and thereby the range of the projectile. Furthermore, this arrangement will prevent damage to the detonating signal charge section 19. Furthermore, in practice projectile 10, the fuse 14 is designed to discharge a smoke signal upon impact with the ground. The specific ratio of the area of the exit openings 13 with respect to the area of the ingress openings 15 in this particular embodiment is about five to one (5:1).

Figure 2:
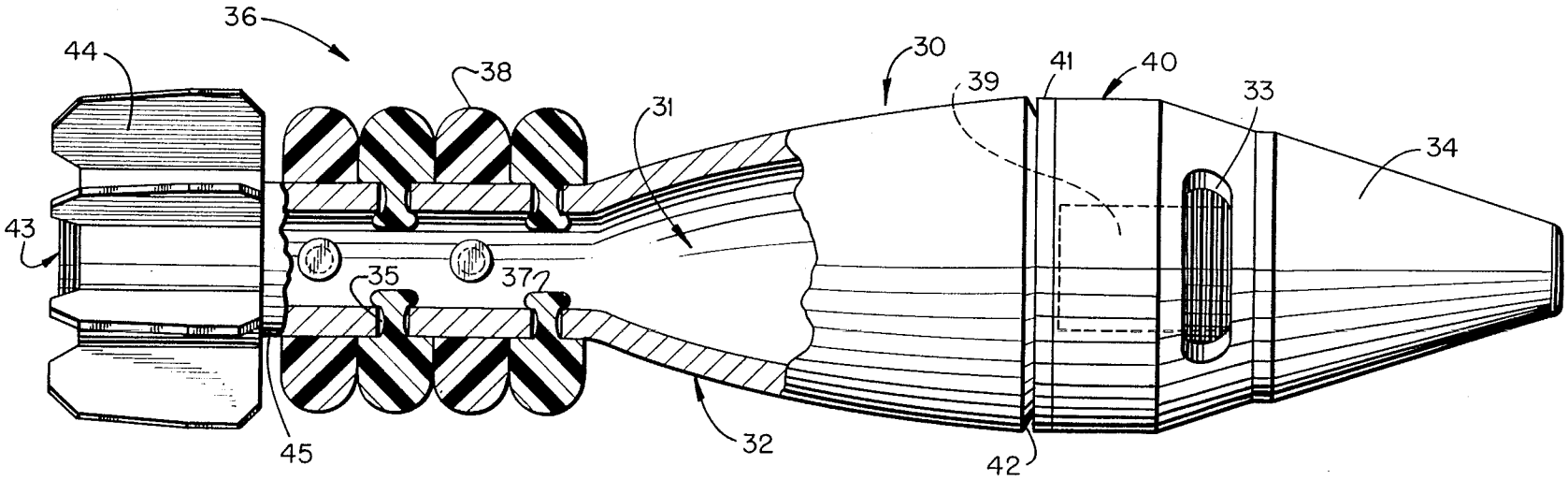
FIG. 2 is a fragmentary sectional view of another embodiment of a projectile made in accordance with this invention.

The fin-stabilized projectile 30 as shown in FIG. 2 constitutes another embodiment of this invention. The shell body portion 32 is threadingly engaged at its front end section to a fuse assembly 34. The spotting charge or signal detonating charge 39 of fuse 34 extends into the gas-conveying passage 31 of shell body portion 32. Shell body portion 32 includes a tail portion 36 having fins 44 and an auxiliary charge holding section 45. A single ignition charge 43 is located in the tail portion 36 and operates in the same fashion as in the other embodiments disclosed herein.

Shell body portion 32 has an outer surface which includes an outer, caliber section 40 which contacts the inside surface of the barrel out of which the projectile 30 is fired. Obturating ring 41 located in the annular groove 42 operates to block the passage of propellant gases past the outer, caliber section 40 upon the denotating of the ignition charge 43.

The auxiliary charge holding section 45 includes a plurality of openings 35 into which plug members 37 are disposed. The four donut-shaped rings 38 include the plug members 37 and simulate the standard incremental charges used when firing actual ammunition using the known propellant increment charges. With four simulated incremental charges 38 in place, all of the openings 35 are plugged and, upon detonation of the charge 43, the range of projectile 30 is maximized. Whenever any one of the simulated incremental charges 38 are removed so that plugs 37 uncover openings 35, the propellant gases are then allowed to move into the openings 35 through the gas-conveying passage 31 and out the slot-shaped openings 33. Again, the exit openings 33 prevent pressure build-up within the gas-conveying 31 and thereby facilitate the selection, and of the range for the practice shell. As shown, plug members 37 are individually shaped to separately and independently close each of the plurality of openings 35 as desired.

Figure 3:
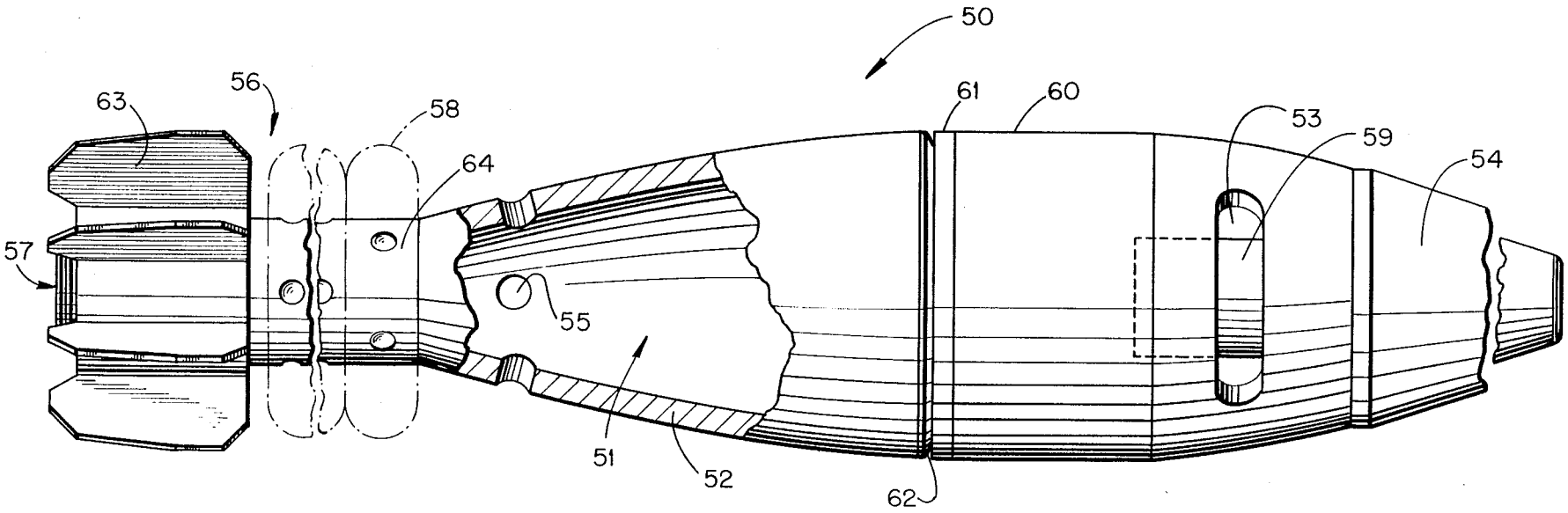
FIG. 3 is a fragmentary sectional view of a further embodiment of a projectile made in accordance with this invention.

The fin-stabilized projectile 50 as shown in FIG. 3 constitutes a still further embodiment of the invention. Projectile 50 includes a shell body portion 52 which is threadingly engaged at its front end section to a fuse portion 54 which includes a spotting charge or signal denotating charge section 59. The tail end portion 56 threadingly engages the rear end portion of shell body portion 52. Tail portion 56 includes fins 63, an auxiliary charge holding section 64 and the ignition charge, generally designated 57. Actual incremental charges 58 are shown in phantom and may be used in conjunction with this embodiment.

The outer surface of shell body portion 52 includes an outer, caliber section 60 which contacts the inside surface of the barrel out of which the projectile 50 is fired. Obturating ring 61 disposed in the circumferential, annular groove 62 operates in the same fashion as in the other embodiments as described herein. Shell body portion 52 includes propellant gas ingress openings 55 located in the rear end section thereof and propellant gas exit openings 53 located in the front end section thereof. Slotted openings 53 are 0.375 inch wide and 1.25 inch long and 180° apart on both sides of the projectile.

In this specific embodiment the outside surface of auxiliary charge holding section 64 carries up to four incremental propellant charges 58. The size of the openings 55 provide a total area effective to produce a preselected projectile range when using any combination of propellant charges 58 with the ignition charge 57. This is, with all of the openings 55 remaining uncovered, the maximum range for the projectile is achieved when four standard incremental charges 58 are placed on the tail section 56 in a manner well known.

Thus this embodiment simulates the use of the additional charges. The preselected projectile ranges for firing an 81 mm caliber projectile with the propellant charges 58 may be as follows:

First ignition propellant charge only—about 250 meters
One additional incremental charge—about 300 meters
Two additional incremental charges—about 400 meters
Three additional incremental charges—about 500 meters
Four additional incremental charges—about 600 meters The exit aperture means includes openings 53 having an area that is greater than the total area of all of the ingress openings 55 by an amount sufficient to prevent pressure build-up within gas-conveying passage 51 thereby avoiding any damage to the spotting charge or signal detonating charge 59. The ratio of the area of the exit openings 53 with respect to the area of the ingress openings is from about three to about five times the total area of the openings 55 located in the rear end section of shell body portion 52.

While the practice projectile with variable range has been shown and described in detail, it is obvious that this invention is not to be considered as being limited to the exact form disclosed, and the changes in detail and construction may be made therein within the scope of the invention, without departing from the spirit thereof.

I claim:

1. In a practice mortar shell having a shell portion, a fuse portion and a finned tail portion for firing from the barrel of a firearm, the combination comprising:

(a) the shell body portion having a front end section and a rear end section and including an outer surface, an inner gas-conveying passage, propellant gas ingress aperture means and propellant gas exit aperture means, (b) the outer surface including an outer, caliber section which contacts the inside surface of the barrel out of which barrel the shell is fired, (c) the outer caliber section is located intermediate the front and rear end sections, (d) the inner gas-conveying passage extends inside the shell body portion between the front end and rear end sections, (e) propellant gas ingress aperture means are located in the rear end section behind the outer, caliber section and openly connect the rear end section of the inner gas-conveying passage to the outside of the shell body portion immediately upon firing of the firearm, and (f) the propellant gas exit aperture means are located in the front end section ahead of the outer, caliber section and openly connect the front end section of the inner gas-conveying passage to the outside of the shell body portion, (g) upon firing of the firearm, said shell body being effective to direct propellant gases immediately upon firing to move from outside the shell body portion into and through the propellant gas ingress aperture means, forwardly within the shell body portion along the inner gas-conveying passage and out the propellant gas exit aperture means for controlling the overall projectile range of the mortar shell, means, (h) the exit aperture means having an opening with a sufficient amount of area compared to the area of the ingress opening means to avoid damage in pressure build-up inside the shell body.

2. A shell as defined in claim 1 wherein the ingress aperture means includes a plurality of openings disposed at preselected locations along the circumference of the shell body portion.

3. A shell as defined in claim 2 wherein the propellant gas ingress aperture means includes plug means for closing the openings.

4. A shell as defined in claim 3 wherein the plug means includes plug members individually shaped to separately and independently close each of the plurality of openings, whereby the range of a projectile incorporating said shell portion is shortened for each plug member which is removed from an opening to unplug the said opening thereby allowing the propellant gas pressure to be released through the gas-conveying passage and out of the propellant gas exit opening.

5. A shell as defined in claim 4 wherein the plug members include donut-shaped sections which simulate the shape of the donut-shaped charge members used to propel fin-stabilized projectiles.

6. A shell as defined in claim 4 wherein the plug members include individual, formed plug sections shaped to fit the profile of the propellant-gas ingress openings.

7. A shell as defined in claim 2 wherein the finned tail portion includes an end fin section and an auxiliary charge holding section effective to contain a plurality of charges to simulate an actual fin-stabilized projectile, the opening area of the exit aperture means being in a predetermined ratio with respect to the opening area of the ingress aperture means, so that the area of the ingress openings is effective to provide a predetermined measured projectile range.

8. A shell as defined in claim 1 wherein the exit aperture means has an opening area of a minimum of 3 times the opening area of the ingress aperture means.

9. A shell as defined in claim 1 wherein the shell body portion is disposed between a fuse portion located at said front end section and a tail portion located at said rear end section, the fuse portion includes a detonating signal charge section which extends into the gas-conveying passage of the shell body portion, the exit and ingress aperture means each has an opening area and the ratio between the exit and ingress opening areas is effective to preclude pressure build-up within the shell body for preventing damage to the detonating signal charge section and is effective to allow the total opening area of the ingress opening areas to govern the muzzle velocity of the shell.

10. A shell as defined in claim 1 wherein the ingress aperture means includes three openings and plug means for closing each of the openings separately and independently with respect to each other, the exit aperture means includes an opening area that is greater than the total area of all of the ingress openings by an amount sufficient to prevent pressure build-up within the gas-conveying passage.

11. A shell as defined in claim 10 wherein the ratio of the area of the exit openings with respect to the area of the ingress openings is a minimum of 3 to 1.

12. A shell as defined in claim 11 wherein the shell body portion is disposed between a fuse portion located at said front end section and a tail portion located at said rear end section, there is a single ignition charge located in the tail portion.

13. A shell as defined in claim 1 wherein:

the shell body portion is disposed between a fuse portion located at said front end section and a tail portion located at said rear end section, the tail portion includes a first ignition propellant charge on the inside thereof and an outside surface section for carrying a preselected number of incremental propellant charge members, said ingress aperture means includes an opening area effective to provide a preselected projectile range when using any combination of the propellant charges.

14. A shell as defined in claim 13 wherein the preselected projectile ranges for firing the projectile with the propellant charges is as follows:

first ignition propellant charge only—about 250 meters one additional incremental charge—about 300 meters two additional incremental charges—about 400 meters three additional incremental charges—about 500 meters four additional incremental charges—about 600 meters.

* * * * *